US009441473B2

(12) United States Patent
Kaminsky

(10) Patent No.: US 9,441,473 B2
(45) Date of Patent: Sep. 13, 2016

(54) ON-SITE GENERATION OF A FRACTURING FLUID STREAM AND SYSTEMS AND METHODS UTILIZING THE SAME

(71) Applicant: Robert D. Kaminsky, Houston, TX (US)

(72) Inventor: Robert D. Kaminsky, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 139 days.

(21) Appl. No.: 14/205,615

(22) Filed: Mar. 12, 2014

(65) Prior Publication Data

US 2014/0367109 A1 Dec. 18, 2014

Related U.S. Application Data

(60) Provisional application No. 61/834,304, filed on Jun. 12, 2013.

(51) Int. Cl.
*E21B 43/26* (2006.01)

(52) U.S. Cl.
CPC ..... *E21B 43/26* (2013.01)

(58) Field of Classification Search
CPC .... E21B 43/168; E21B 43/26; E21B 43/006; E21B 43/164; E21B 43/24; E21B 43/247; E21B 36/001; E21B 43/40; E21B 43/16; E21B 36/025
See application file for complete search history.

(56) References Cited

U.S. PATENT DOCUMENTS 3,937,283 A 2/1976 Blauer et al.
4,057,510 A 11/1977 Crouch et al.
4,113,019 A 9/1978 Sobolev et al.
4,119,566 A 10/1978 Crouch et al.
4,218,326 A 8/1980 Crouch et al.
5,069,283 A 12/1991 Mack
5,424,285 A 6/1995 Stacy et al.
5,560,737 A 10/1996 Schuring et al.
5,607,903 A 3/1997 Bastos
6,634,433 B2 10/2003 Kim et al.
7,296,399 B2 11/2007 Hoff, Jr.
7,451,820 B2 11/2008 Albers et al.

(Continued)

OTHER PUBLICATIONS

Abel, J. C., "Application of Nitrogen Fracturing in the Ohio Shale", SPE 10378, 1981, pp. 189-197 www.hamworthy.com/PageFiles/694/Moss/Mult-InertSystemBROCHURE.pdf.

(Continued)

*Primary Examiner* — Angela M DiTrani
*Assistant Examiner* — Charles R Nold
(74) *Attorney, Agent, or Firm* — ExxonMobil Upstream Research Company—Law Department

(57) ABSTRACT

On-site generation of a fracturing fluid stream system includes a fracturing fluid generation assembly and a fracturing fluid supply assembly. The fracturing fluid generation assembly is configured to receive a hydrocarbon stream and to generate a fracturing fluid stream from the hydrocarbon stream. The fracturing fluid stream has an oxygen concentration, which is less than a limiting oxygen concentration for supporting combustion of a combustible fluid that is present within a subterranean formation. The fracturing fluid stream also has a combustible portion, which defines a concentration that is below a lower flammability limit of the combustible portion in the fracturing fluid stream. The fracturing fluid supply assembly is configured to receive the fracturing fluid stream and to convey the fracturing fluid stream to the subterranean formation to fracture the subterranean formation.

11 Claims, 7 Drawing Sheets

(56) References Cited

U.S. PATENT DOCUMENTS

| | | | | |
|---|---|---|---|---|
| 2007/0266632 | A1* | 11/2007 | Tsangaris | C10J 3/18 48/190 |
| 2011/0290490 | A1* | 12/2011 | Kaminsky | C01B 3/22 166/302 |
| 2012/0067568 | A1* | 3/2012 | Palmer | E21B 36/02 166/256 |

OTHER PUBLICATIONS

Hamworthy, "Moss Inert Gas Generator System", 4 pages www.steamexfire.com.

Steamexfire, "Steamexfire 2500, the largest jet inertisation gas generator globaly available", 3 pages.

* cited by examiner

ON-SITE GENERATION OF A FRACTURING FLUID STREAM AND SYSTEMS AND METHODS UTILIZING THE SAME

CROSS REFERENCE TO RELATED APPLICATIONS

This application claims the benefit of U.S. Provisional No. 61/834,304, filed Jun. 12, 2013, which is incorporated by reference herein in its' entirety.

FIELD OF THE DISCLOSURE

The present disclosure is directed generally to on-site generation of a fracturing fluid stream, and more particularly to systems and methods that utilize a combustible stream to generate the fracturing fluid stream.

BACKGROUND OF THE DISCLOSURE

Under certain conditions, it may be desirable to fracture a subterranean formation to increase a permeability thereof and/or to increase a production rate of combustible fluids that may be contained therein. Traditionally, hydraulic fracturing has been utilized to fracture the subterranean formation. As an illustrative, non-exclusive example, water may be pumped into the subterranean formation to generate a pressure within the subterranean formation that is greater than a fracture pressure thereof, and thereby to fracture the subterranean formation. Subsequently, or concurrently, a proppant may be provided to the fractured subterranean formation to maintain fluid flow within the fracture while permitting a decrease in the pressure within the subterranean formation.

While water may be effective at fracturing the subterranean formation, it may be in short supply, may be in high demand for other applications, and/or may damage some subterranean formations. Additionally or alternatively, and subsequent to fracturing of the subterranean formation, it may be necessary to remove contaminants from the water and/or to provide additional processing of the water prior to disposal thereof. Thus, there exists a need for improved systems and methods for on-site generation of a fracturing fluid stream that includes little or no water.

SUMMARY OF THE DISCLOSURE

On-site generation of a fracturing fluid stream and systems and methods including and/or utilizing the same are disclosed herein. The systems include a fracturing fluid generation assembly and a fracturing fluid supply assembly. The fracturing fluid generation assembly is configured to receive a hydrocarbon stream and to generate therefrom a fracturing fluid stream for fracturing a subterranean formation. The fracturing fluid stream has an oxygen concentration, which is less than a limiting oxygen concentration for supporting combustion of a combustible fluid that is present within the subterranean formation. The fracturing fluid stream also has a combustible portion, which has, or defines, a concentration that is below a lower flammability limit of the combustible portion in the fracturing fluid stream. The fracturing fluid supply assembly is configured to receive the fracturing fluid stream and to convey the fracturing fluid stream to the subterranean formation to fracture the subterranean formation. The methods include methods for generating the fracturing fluid stream and/or for enhancing production of a combustible fluid from a region of a subterranean formation.

In some embodiments, the systems and methods include combusting the hydrocarbon stream to generate at least a portion of the fracturing fluid stream. In some embodiments, the combusting includes combusting the hydrocarbon stream in a combustion assembly. In some embodiments, the combustion assembly includes a low pressure burner. In some embodiments, the combustion assembly includes a high pressure burner.

In some embodiments, the systems and methods include mixing the hydrocarbon stream with a supplemental gas stream to generate the fracturing fluid stream. In some embodiments, the systems and methods include cooling the fracturing fluid stream, removing water from the fracturing fluid stream, compressing the fracturing fluid stream, and/or augmenting the fracturing fluid stream prior to providing the fracturing fluid stream to the subterranean formation.

DETAILED DESCRIPTION AND BEST MODE OF THE DISCLOSURE

Figure 1:
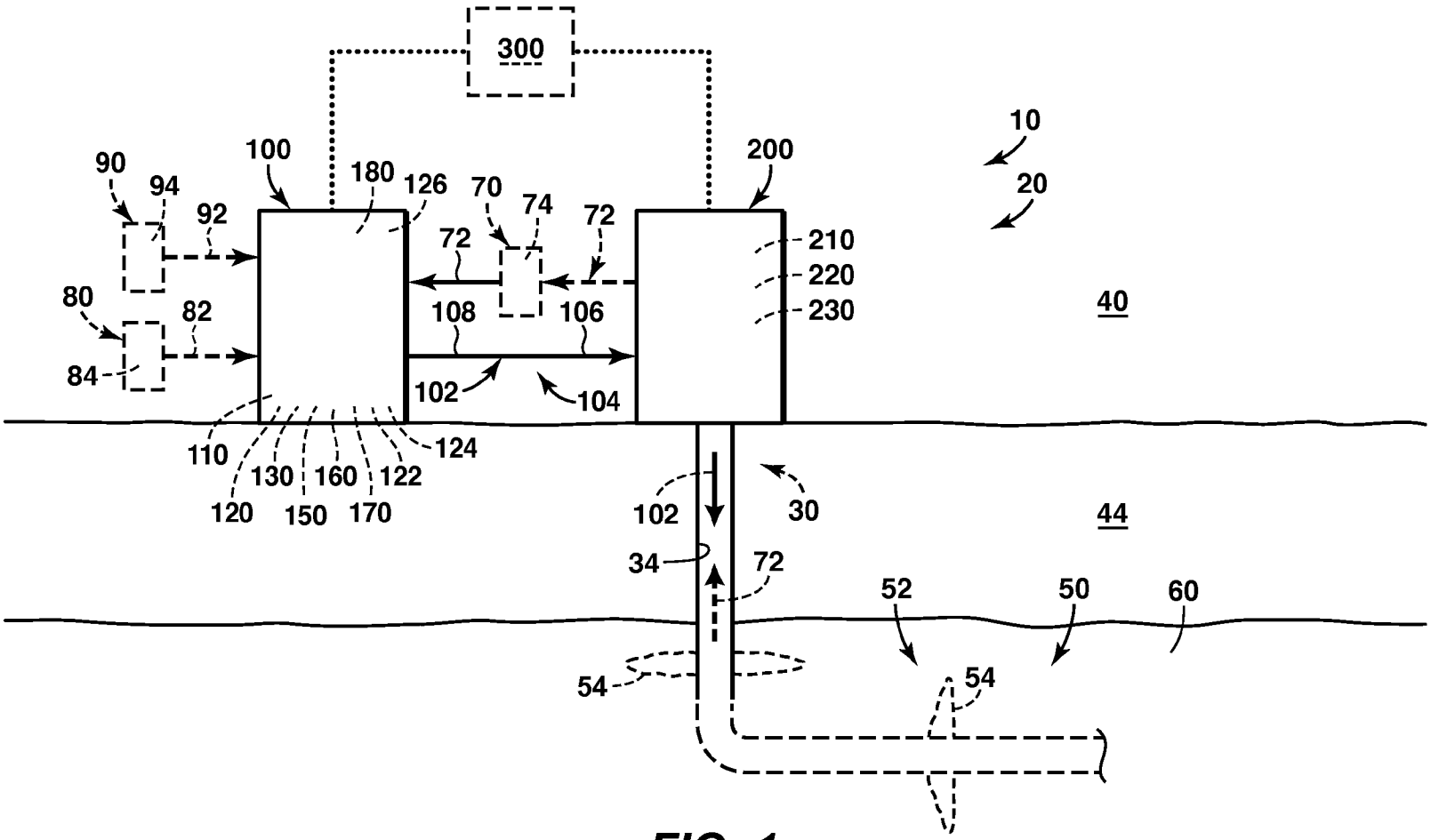
FIG. 1 is a schematic cross-sectional view of illustrative, non-exclusive examples of a hydrocarbon production system that may include a fracture generation system according to the present disclosure.

FIGS. 1-6 provide illustrative, non-exclusive examples of fracturing fluid generation assemblies 100 and components thereof according to the present disclosure. The fracturing fluid generation assemblies may form a portion of, and/or be utilized in, any suitable hydrocarbon production systems 10 and/or fracture generation systems 20. Elements that serve a similar, or at least substantially similar, purpose are labeled with like numbers in each of FIGS. 1-6, and these elements may not be discussed in detail herein with reference to each of FIGS. 1-6. Similarly, all elements may not be labeled in each of FIGS. 1-6, but reference numerals associated therewith may be utilized herein for consistency. Elements, components, and/or features that are discussed herein with reference to one or more of FIGS. 1-6 may be included in and/or utilized with any of FIGS. 1-6 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

Figure 2:
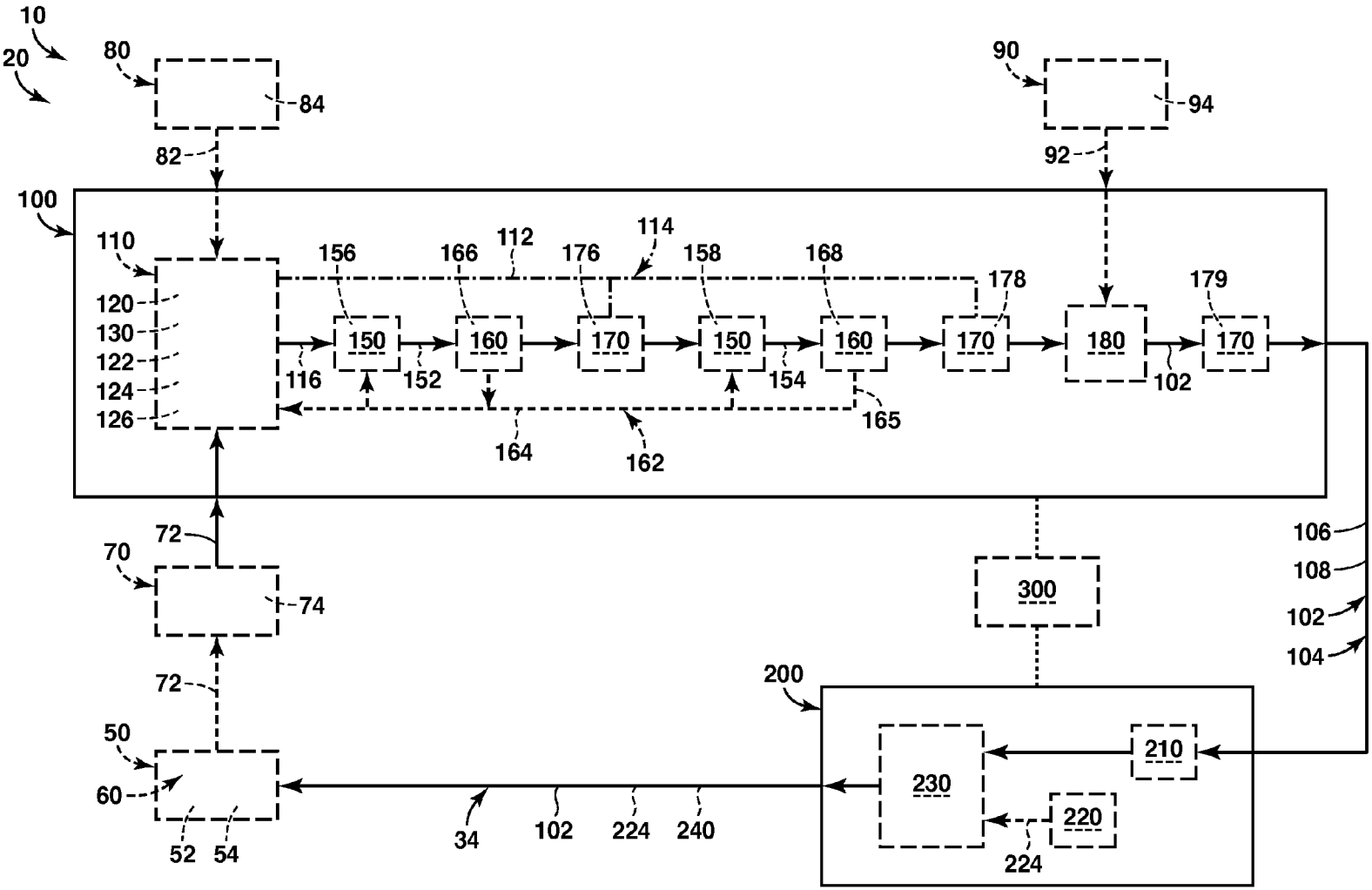
FIG. 2 is a more detailed, but still schematic, representation of illustrative, non-exclusive examples of a fracture generation system according to the present disclosure.

FIG. 1 is a schematic cross-sectional view of illustrative, non-exclusive examples of a hydrocarbon production system 10 that may include a fracture generation system 20 according to the present disclosure. FIG. 2 is a more detailed, but still schematic, representation of illustrative, non-exclusive examples of a fracture generation system 20 according to the present disclosure that may be included in and/or utilized with the hydrocarbon production system of FIG. 1.

Fracture generation system 20 includes a fracturing fluid generation assembly 100 that is configured receive a hydrocarbon stream 72 and to produce, or generate, a fracturing fluid stream 102 at a supply pressure therefrom. Fracturing fluid generation assembly 100 is configured to provide fracturing fluid stream 102 to a fracturing fluid supply assembly 200, such as via a fracturing fluid supply conduit 104. Fracturing fluid supply assembly 200 is configured to convey fracturing fluid stream 102 to a region 52 of a subterranean formation 50 that is to be fractured, such as via a hydrocarbon well 30. After being fractured, region 52 may be referred to as a fractured region 52 of the subterranean formation. Hydrocarbon well 30 includes a wellbore 34 that extends within a subsurface region 44 between a surface region 40 and the subterranean formation (as illustrated in FIG. 1), thereby permitting fluid communication between fracturing fluid supply assembly 200 and subterranean formation 50.

Fracturing fluid stream 102 may include and/or be a gaseous, or at least partially gaseous, stream that includes a combustible portion 106, or combustible fraction 106, that defines a combustible portion concentration of the fracturing fluid stream. The combustible portion comprises chemical compounds that may combust with oxygen under certain, or favorable, conditions (such as when the combustible portion concentration and the oxygen concentration are within certain concentration ranges). The chemical compounds that are present within the combustible portion may comprise hydrocarbons, carbon monoxide, and/or other combustible gasses and/or vapors. Incombustible gasses, such as carbon dioxide and/or nitrogen, may be present within fracturing fluid stream 102 but do not form a portion of combustible portion 106.

The fracturing fluid stream also may include oxygen 108 that defines an oxygen concentration therein. However, fracturing fluid generation assembly 100 is designed, constructed, configured, and/or operated such that the combustible portion concentration, which also may be referred to herein as a concentration of the combustible portion, is below a lower flammability limit of the combustible portion of, or within, the fracturing fluid stream. As such, and even if the fracturing fluid stream is exposed to air (such as via a leak in a supply conduit or other transport line for the fracturing fluid stream) or to other oxygen—and/or oxidant-containing gas streams the fracturing fluid stream cannot combust.

As illustrative, non-exclusive examples, the concentration of the combustible portion may be less than a threshold fraction of the lower flammability limit. This may include combustible portion concentrations of less than 50%, less than 60%, less than 70%, less than 80%, less than 90%, less than 95%, or less than 99% of the lower flammability limit of the combustible portion. As another illustrative, non-exclusive example, the concentration of the combustible portion within the fracturing fluid stream may be less than a threshold combustible portion concentration. As an illustrative, non-exclusive example, and when the combustible portion is natural gas, the threshold combustible portion concentration may include concentrations of less than 5 mole %, less than 4.5 mole %, less than 4 mole %, less than 3.5 mole %, less than 3 mole %, less than 2.5 mole %, less than 2 mole %, less than 1.5 mole %, or less than 1 mole %. As additional more specific but still illustrative, non-exclusive examples, and when the combustible portion is natural gas, the fracturing fluid stream may include at least 25 mole % carbon dioxide and/or at least 38 mole % nitrogen.

These and other mole percentages that are disclosed herein may include and/or be mole percentages of the gaseous components of fracturing fluid stream 102 and/or may be determined on a liquid-free and/or on a water vapor-free basis. As an illustrative, non-exclusive example, fracturing fluid stream 102 further may include water and/or water vapor. However, the mole percentages disclosed herein may be determined based upon the gas composition of the fracturing fluid stream and without regard for an amount, or mole percentage, of water and/or water vapor that is present within the fracturing fluid stream.

In addition, the fracturing fluid generation assembly also is designed, configured, and/or operated such that the oxygen concentration is less than a limiting oxygen concentration for supporting combustion of the combustible fluid within the subterranean formation. As such, injection of fracturing fluid stream 102 into the subterranean formation does not pose a combustion and/or explosion hazard, since the oxygen concentration is insufficient to support combustion of the combustible fluid within the subterranean formation. Additionally or alternatively, and while not required in all embodiments, the oxygen concentration also may be less than a limiting oxygen concentration for supporting combustion of the combustible portion of the fracturing fluid stream.

As illustrative, non-exclusive examples, the oxygen concentration may be less than a threshold fraction of the limiting oxygen concentration. This may include oxygen concentrations of less than 50%, less than 60%, less than 70%, less than 80%, less than 90%, less than 95%, or less than 99% of the limiting oxygen concentration. As more specific but still illustrative, non-exclusive examples, and when the combustible portion is natural gas, the oxygen concentration may be less than a threshold oxygen concentration. This may include oxygen concentrations of less than 12 mole %, less than 11 mole %, less than 10 mole %, less than 9 mole %, less than 8 mole %, less than 7 mole %, less than 6 mole %, less than 5 mole %, less than 4 mole %, less than 3 mole %, less than 2 mole %, or less than 1 mole %.

In operation, fracture generation system 20 supplies fracturing fluid stream 102 to region 52 at a pressure that is greater than or equal to a fracture pressure of region 52 and/or of subterranean formation 50. Thus, supply of the fracturing fluid stream to region 52 generates one or more fractures 54 within the subterranean formation, with these fractures serving to increase a fluid permeability of the subterranean formation and thereby increase a production rate of a combustible fluid 60 that may be present within the subterranean formation. As illustrative, non-exclusive examples, and while the supply pressure will vary with the fracture pressure of region 52, fracturing fluid generation assembly 100 may be configured to produce fracturing fluid stream 102 at a supply pressure of at least 20 megapascals (MPa), at least 25 MPa, at least 30 MPa, at least 35 MPa, at least 40 MPa, at least 45 MPa, at least 50 MPa, at least 55 MPa, or at least 60 MPa.

As illustrated in dashed lines in FIGS. 1-2, combustible fluid 60 optionally may be produced from subterranean formation 50 as hydrocarbon stream 72, at least a portion of which may be provided to fracturing fluid generation assembly 100 to be utilized to generate fracturing fluid stream 102, as discussed in more detail herein. As also illustrated in dashed lines in FIGS. 1-2, fracture generation system 20 may include a hydrocarbon supply system 70 that is configured to provide the hydrocarbon stream to the fracturing fluid generation assembly.

Hydrocarbon supply system 70 may be configured to supply the hydrocarbon stream in any suitable manner. As an illustrative, non-exclusive example, the hydrocarbon supply system may include a hydrocarbon compressor 74 that is configured to compress hydrocarbon stream 72 prior to supply of the hydrocarbon stream to fracturing fluid generation assembly 100. As another illustrative, non-exclusive example, hydrocarbon supply system 70 may be configured to receive hydrocarbon stream 72 from hydrocarbon well 30 (or from another hydrocarbon well 30 that extends within subterranean formation 50) and to supply the hydrocarbon stream to fracturing fluid generation assembly 100. As yet another illustrative, non-exclusive example, hydrocarbon supply system 70 may supply hydrocarbon stream 72 from a hydrocarbon source other than subterranean formation 50 and/or from another subterranean formation 50.

Regardless of the source of hydrocarbon stream 72, the hydrocarbon stream may be provided to fracturing fluid generation assembly 100 at an elevated pressure. This may include increasing the pressure of hydrocarbon stream 72 to the elevated pressure (such as through the use of hydrocarbon compressor 74) and/or receipt and/or use of a hydrocarbon stream 72 that is already at the elevated pressure (such as a pressure at which the hydrocarbon stream may be produced from subterranean formation 50). As illustrative, non-exclusive examples, the hydrocarbon stream may define a pressure of at least 0.5 megapascals (MPa), at least 1 MPa, at least 2 MPa, at least 5 MPa, at least 10 MPa, at least 20 MPa, at least 25 MPa, at least 30 MPa, at least 35 MPa, at least 40 MPa, at least 45 MPa, at least 50 MPa, at least 55 MPa, or at least 60 MPa.

As discussed in more detail herein, fracture generation system 20 further may include and/or be in fluid communication with an oxidant supply system 80 and/or a supplemental gas supply system 90. Oxidant supply system 80 may be configured to provide an oxidant stream 82 to fracturing fluid generation assembly 100. As an illustrative, non-exclusive example, oxidant supply system 80 may include and/or be an air compressor 84 that is configured to provide a pressurized air stream to fracturing fluid generation assembly 100 as the oxidant stream. It is within the scope of the present disclosure that the pressurized air stream may be delivered to fracturing fluid generation assembly 100 (or produced from air compressor 84) at any suitable pressure. As illustrative, non-exclusive examples, the pressurized air stream may define an air stream pressure of at least 0.5 megapascals (MPa), at least 1 MPa, at least 2 MPa, at least 5 MPa, at least 10 MPa, at least 20 MPa, at least 25 MPa, at least 30 MPa, at least 35 MPa, at least 40 MPa, at least 45 MPa, at least 50 MPa, at least 55 MPa, or at least 60 MPa.

Similarly, supplemental gas supply system 90 may be configured to provide a supplemental gas stream 92 to fracturing fluid generation assembly 100. As an illustrative, non-exclusive example, supplemental gas supply system 90 may include and/or be a supplemental gas stream compressor 94 that is configured to generate and/or provide the supplemental gas stream. Illustrative, non-exclusive examples of supplemental gas streams 92 that may be utilized with and/or included in the systems and methods according to the present disclosure include an inert gas, a gaseous hydrocarbon, nitrogen, carbon dioxide, natural gas, water vapor, and/or methane. It is within the scope of the present disclosure that these materials may comprise any suitable portion, fraction, or percentage of the supplemental gas stream. As illustrative, non-exclusive examples, the supplemental gas stream may comprise at least 80 mole %, at least 85 mole %, at least 90 mole %, at least 99 mole %, or at least 99 mole % of the above-listed materials.

Fracturing fluid generation assembly 100 may be adapted, configured, designed, and/or constructed to generate fracturing fluid stream 102 in any suitable manner and may include any suitable structure. As an illustrative, non-exclusive example, fracturing fluid generation assembly 100 may include a combustion assembly 110, such as a low pressure burner 120 and/or a high pressure burner 130. As discussed in more detail herein, low pressure burner 120 may include and/or be a turbine 122, an afterburner 124, and/or an engine 126, such as an internal combustion engine. Combustion assembly 110 may be configured to receive hydrocarbon stream 72 and oxidant stream 82 and to combust the hydrocarbon stream in, or with, the oxidant stream to produce a combustion gas stream 116 (as illustrated in FIG. 2), with combustion gas stream 116 forming a portion, or even all, of fracturing fluid stream 102.

When fracturing fluid generation assembly 100 includes combustion assembly 110, fracturing fluid stream 102 (or combustion gas stream 116) may include nitrogen and carbon dioxide. As illustrative, non-exclusive examples, fracturing fluid stream 102 may include at least 70 mole % nitrogen, at least 71 mole % nitrogen, at least 72 mole % nitrogen, at least 73 mole % nitrogen, at least 74 mole % nitrogen, at least 75 mole % nitrogen, at least 76 mole % nitrogen, at least 78 mole % nitrogen, or at least 80 mole % nitrogen. Additionally or alternatively, fracturing fluid stream 102 also may include at least 6 mole % carbon dioxide, at least 7 mole % carbon dioxide, at least 8 mole % carbon dioxide, at least 9 mole % carbon dioxide, or at least 10 mole % carbon dioxide.

As illustrated in more detail in FIG. 2, fracturing fluid generation assembly 100 further may include a cooling structure 150. Illustrative, non-exclusive examples of cooling structures 150 that may be utilized with and/or included in the systems and methods according to the present discourse include a heat exchanger and/or a direct water contact assembly. Cooling structure 150 may be configured to receive combustion gas stream 116 and to cool the combustion gas stream to generate a cooled combustion gas stream 152 therefrom, with the cooled combustion gas stream forming a portion, or even all, of fracturing fluid stream 102.

Fracturing fluid generation assembly 100 also may include a gas-liquid separation assembly 160. Gas-liquid separation assembly 160 may be configured to receive cooled combustion gas stream 152 and to remove a liquid stream 164, which also may be referred to herein as a water stream 164, therefrom. Liquid stream 164 may be discharged from gas-liquid separation assembly 160 and/or may be recycled within fracturing fluid generation assembly 100 and/or fracture generation system 20, such as via any suitable recycle conduit 162. As an illustrative, non-exclusive example, and as discussed in more detail herein, liquid stream 164 may be recycled, or provided, to combustion assembly 110 to cool the combustion assembly. As another illustrative, non-exclusive example, liquid stream 164 may be recycled, or provided, to cooling structure 150 to cool combustion gas stream 116.

Fracturing fluid generation assembly 100 further may include a gas compression assembly 170. Gas compression assembly 170 may be configured to receive cooled combustion gas stream 152 from cooling structure 150 and/or from gas-liquid separation assembly 160 and to pressurize, or increase the pressure of, the cooled combustion gas stream. As an illustrative, non-exclusive example, gas compression assembly 170 may be configured to pressurize cooled combustion gas stream 152 to the supply pressure.

As another illustrative, non-exclusive example, previously discussed cooling structure 150 may be a first cooling structure 156, previously discussed gas-liquid separation assembly 160 may be a first gas-liquid separation assembly 166, and previously discussed gas compression assembly 170 may be a first gas compression assembly 176. Under these conditions, and as illustrated in FIG. 2, fracturing fluid generation assembly 100 optionally further may include a second cooling structure 158, a second gas-liquid separation assembly 168, and/or a second gas compression assembly 178.

Second cooling structure 158 may be configured to receive cooled combustion gas stream 152, which also may be referred to herein as a first cooled combustion gas stream 152, and to generated a second cooled combustion gas stream 154 therefrom. Second cooled combustion gas stream 154 may form a portion, or even all, of fracturing fluid stream 102 and subsequently may be provided to second gas-liquid separation assembly 168. Second gas-liquid separation assembly 168 may be configured to receive second cooled combustion gas stream 154 and to separate a second liquid stream 165 therefrom. The second liquid stream may be utilized and/or disposed of in any suitable manner, including a manner that is the same as or similar to that of liquid stream 164, which also may be referred to herein as first liquid stream 164.

The second cooled combustion gas stream then may be provided to second gas compression assembly 178. Second gas compression assembly 178, when present, may be configured to receive second cooled combustion gas stream 154 and to compress the second cooled combustion gas stream to the supply pressure.

Regardless of the number and/or construction of cooling structures 150, 156, and/or 158 that may be present within fracturing fluid generation assembly 100, the fracturing fluid generation assembly may be configured to provide fracturing fluid stream 102 to hydrocarbon well 30 and/or to subterranean formation 50 at a supply temperature that is within a specified supply temperature range. As illustrative, non-exclusive examples, fracturing fluid stream 102 may be provided to hydrocarbon well 30 at a supply temperature of at least 5° C., at least 10° C., at least 15° C., at least 20° C., at least 25° C., at least 30° C., at least 35° C., at least 40° C., at least 45° C., or at least 50° C. Additionally or alternatively, fracturing fluid stream 102 also may be provided to hydrocarbon well 30 at a supply temperature of less than 200° C., less than 190° C., less than 180° C., less than 170° C., less than 160° C., less than 155° C., less than 150° C., less than 145° C., less than 140° C., less than 130° C., less than 120° C., less than 110° C., or less than 100° C.

It is within the scope of the present disclosure that combustion assembly 110 may be configured to generate a power output 112 during and/or as a result of combustion of hydrocarbon stream 72 therein. Under these conditions, and as illustrated in dash-dot lines in FIG. 2, fracturing fluid generation assembly 100 further may include a power transfer structure 114. Power transfer structure 114 may be configured to convey power output 112 from combustion assembly 110 to another portion of fracture generation system 20 and/or fracturing fluid generation assembly 100 thereof to provide the power output thereto. As an illustrative, non-exclusive example, and as illustrated in FIG. 2, power transfer structure 114 may be configured to provide power output 112 to first gas compression assembly 176 and/or to second gas compression assembly 178 to provide, or supply, at least a portion of a power demand thereof.

It is within the scope of the present disclosure that combustion gas stream 116, first cooled combustion gas stream 152 (when present), and/or second cooled combustion gas stream 154 (when present) may be suitable for production from, and/or may be produced from, fracturing fluid generation assembly 100 as fracturing fluid stream 102. However, it also is within the scope of the present disclosure that fracturing fluid generation assembly 100 further may include a mixing structure 180. Mixing structure 180 may be configured to receive supplemental gas stream 92 and combustion gas stream 116, first cooled combustion gas stream 152 (when present), and/or second cooled combustion gas stream 154 (when present) and to combine the respective streams therein to produce fracturing fluid stream 102.

Additionally or alternatively, it is also within the scope of the present disclosure that fracturing fluid generation assembly 100 may not include one or more of combustion assembly 110, cooling structures 150, gas-liquid separation assemblies 160, and/or gas compression assemblies 170. Under these conditions, fracturing fluid generation assembly 100 may be configured to provide hydrocarbon stream 72 directly to mixing structure 180. Mixing structure 180 then may combine the hydrocarbon stream with supplemental gas stream 92 to generate fracturing fluid stream 102.

Subsequent to being produced from mixing structure 180, fracturing fluid stream 102 then may be compressed within a gas compression assembly 170, which also may be referred to herein as a third gas compression assembly 179. Third gas compression assembly 179, when present, may be configured to compress fracturing fluid stream 102 to the supply pressure, which may be greater than, or at least equal to, the fracture pressure of subterranean formation 50.

Regardless of the exact configuration of fracturing fluid generation assembly 100, and as discussed, fracturing fluid stream 102 that is generated thereby includes combustible portion 106 and also may include oxygen (gas) 108. In addition, and as also discussed, the concentration of the combustible portion in, or within, the fracturing fluid stream is below the lower flammability limit thereof. Similarly, the oxygen concentration in, or within, the fracturing fluid stream is less than the limiting oxygen concentration for supporting combustion of combustible fluid 60 that is present within subterranean formation 50.

As such, fracturing fluid stream 102 cannot combust when mixed and/or otherwise combined with air (such as might occur were the fracturing fluid stream to leak from fracture generation system 20 into the air). Similarly, fracturing fluid stream 102 also cannot cause combustion of combustible fluid 60 when mixed therewith within subterranean formation 50. Thus, fracturing fluid generation assembly 100 permits on-site generation of a fracturing fluid stream 102 that may be utilized to fracture subterranean formation 50 without a potential for fires and/or explosions in surface region 40 and/or in subsurface region 44.

As illustrated in FIGS. 1-2 and discussed herein, fracture generation system 20 further includes fracturing fluid supply assembly 200, which is configured to receive fracturing fluid stream 102 and to convey the fracturing fluid stream to subterranean formation 50. As illustrated in more detail in FIG. 2, fracturing fluid supply assembly 200 may include a fracturing fluid flow control assembly 210 that is configured to receive the fracturing fluid stream and to control a flow rate of the fracturing fluid stream that is provided to subterranean formation 50. Fracturing fluid supply assembly 200 also may include an augmentation structure 230 that is configured to receive an augmentation material stream 224 from an augmentation material supply system 220 and to combine the augmentation material stream with the fracturing fluid stream to generate an augmented fracturing fluid stream 240. Augmented fracturing fluid stream 240 then may be provided to the subterranean formation.

Fracturing fluid flow control assembly 210 may include any suitable structure that is configured to receive fracturing fluid stream 102 and to selectively control the flow rate thereof. This may include selectively supplying the fracturing fluid stream to the subterranean formation at a plurality of distinct flow rates, selectively supplying the fracturing fluid stream to the subterranean formation at a flow rate that is sufficient to fracture the subterranean formation, and/or periodically providing the fracturing fluid stream to the subterranean formation.

Augmenting structure 230 may include any suitable structure that is configured to combine fracturing fluid stream 102 with augmentation material stream 224 to generate augmented fracturing fluid stream 240. Augmentation material supply system 220 may include any suitable structure that is configured to selectively supply augmentation material stream 224, which may include a liquid, water, a foaming agent, and/or a proppant, to augmenting structure 230. This may include selectively supplying the augmentation material stream a portion, or even all, of a time period during which fracturing fluid stream 102 is being received by fracturing fluid supply assembly 200 and/or provided to subterranean formation 50.

As an illustrative, non-exclusive example, the augmentation material supply system may be configured to provide the augmentation material stream subsequent to generation of fractures within subterranean formation 50, such as when the augmentation material stream includes the proppant. As another illustrative, non-exclusive example, the augmentation material supply system may be configured to selectively provide the liquid, water, and/or the foaming agent to carry the proppant within the (gaseous) fracturing fluid stream into the subterranean formation.

It is within the scope of the present disclosure that augmentation material stream 224 may comprise any suitable portion, or fraction, of augmented fracturing fluid stream 240. As illustrative, non-exclusive examples, the augmentation material stream may comprise less than 40 volume %, less than 35 volume %, less than 30 volume %, less than 25 volume %, less than 20 volume %, less than 15 volume %, less than 10 volume %, or less than 5 volume % of the augmented fracturing fluid stream at a temperature and pressure at which the augmented fracturing fluid stream is supplied to the subterranean formation.

Fracture generation system 20 further may include, be associated with, and/or be in communication with an optional controller 300 that is adapted, configured, and/or programmed to control the operation of at least a portion of the fracture generation system. As illustrative, non-exclusive examples, and as illustrated in FIGS. 1-2, controller 300 may be in communication with and/or programmed to control the operation of fracturing fluid generation assembly 100 and/or of fracturing fluid supply assembly 200. As additional illustrative, non-exclusive examples, controller 300 may be programmed to control the operation of the fracture generation system according to, and/or by executing, methods 400 and/or methods 500, which are discussed in more detail herein.

Figure 3:
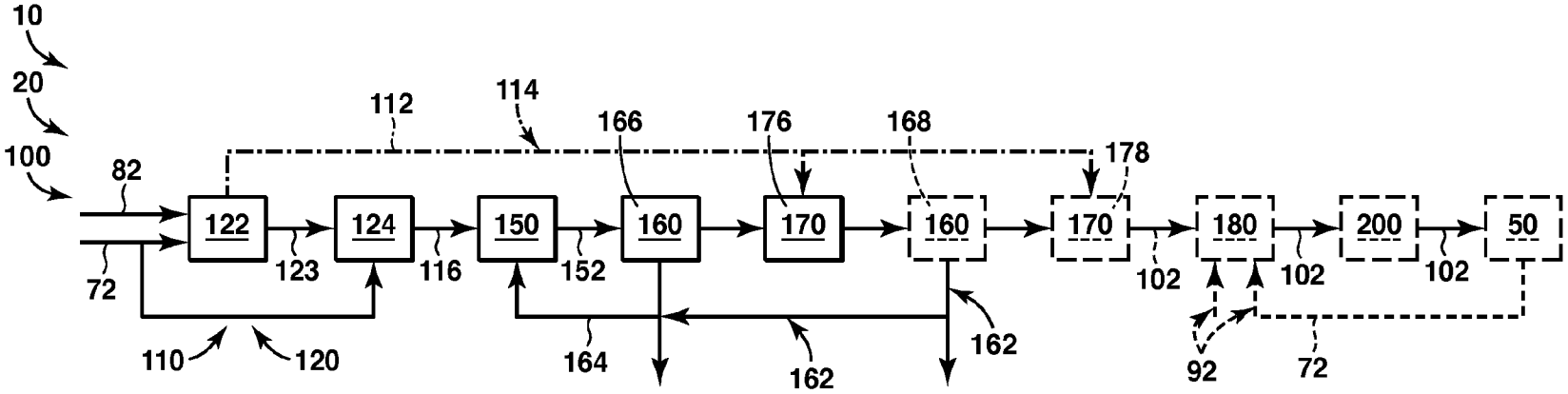
FIG. 3 is a schematic representation of illustrative, non-exclusive examples of a fracturing fluid generation assembly according to the present disclosure.

FIG. 3 is a schematic representation of illustrative, non-exclusive examples of a fracturing fluid generation assembly 100 according to the present disclosure that includes a combustion assembly 110 in the form of a low pressure burner 120. In FIG. 3, low pressure burner 120 includes a turbine 122, which is configured to receive a hydrocarbon stream 72 (such as from hydrocarbon supply system 70 of FIGS. 1-2) and an oxidant stream 82 (such as from oxidant supply system 80 of FIGS. 1-2). Turbine 122 is configured to combust a first portion of hydrocarbon stream 72 with oxidant stream 82 (or a first portion of the oxidant stream) to generate a turbine exhaust stream 123 and a power output 112.

Low pressure burner 120 may further include an afterburner 124 that is configured to receive turbine exhaust stream 123. Afterburner 124 combusts a second portion of hydrocarbon stream 72 that is contained within turbine exhaust stream 123 to generate a combustion gas stream 116.

Fracturing fluid generation assembly 100 further includes a cooling structure 150 that is configured to cool combustion gas stream 116 to generate a cooled combustion gas stream 152. Cooled combustion gas stream 152 may be provided to a gas-liquid separation assembly 160 that is configured to separate a liquid stream 164 therefrom, with this liquid stream being provided to cooling structure 150 in a recycle conduit 162 and utilized within the cooling structure to cool combustion gas stream 116. A remainder of the cooled combustion gas stream then may be provided to a gas compression assembly 170 that is configured to pressurize the cooled combustion gas stream. As discussed herein with reference to FIGS. 1-2, gas compression assembly 170 may be configured to compress the cooled gas stream to the supply pressure to generate at least a portion of, or the entire, fracturing fluid stream 102. Alternatively, and as illustrated in dashed lines in FIG. 3, fracturing fluid generation assembly 100 further may include a second stage of cooling and/or compression that utilizes a second gas-liquid separation assembly 168 and/or a second gas compression assembly 178.

Fracturing fluid generation assembly 100 further includes a power transfer structure 114. Power transfer structure 114 is configured to convey power output 112 from turbine 122 to gas compression assemblies 170 to thereby provide at least a portion of the power demand thereof.

As discussed in more detail herein with reference to FIGS. 1-2, the fracturing fluid generation assembly of FIG. 3 also may include a mixing structure 180 that may be configured to receive a supplemental gas stream 92 and the portion of fracturing fluid stream 102 from fracturing fluid generation assembly 100. The mixing structure then may combine the portion of the fracturing fluid stream with the supplemental gas stream to generate fracturing fluid stream 102. The fracturing fluid stream then may be provided to a fracturing fluid supply assembly 200 before being provided to subterranean formation 50.

Supplemental gas stream 92 may include any suitable material and/or may be provided to mixing structure 180 from any suitable source, as discussed herein. As an additional illustrative, non-exclusive example, and as illustrated in dashed lines in FIG. 3, supplemental gas stream 92 may include and/or be a hydrocarbon stream 72 that may be produced from subterranean formation 50.

Figure 4:
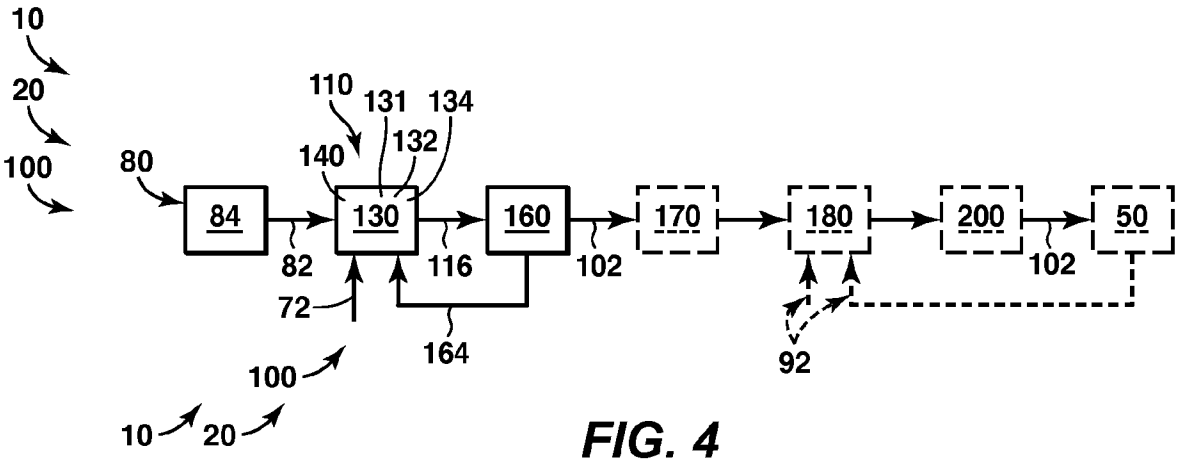
FIG. 4 is another schematic representation of illustrative, non-exclusive examples of a fracturing fluid generation assembly according to the present disclosure.

FIG. 4 is another schematic representation of illustrative, non-exclusive examples of a fracturing fluid generation assembly 100 according to the present disclosure that includes a combustion assembly 110 in the form of a high pressure burner 130. The fracturing fluid generation assembly of FIG. 4 includes an oxidant supply system 80 that includes an air compressor 84 that is configured to generate an oxidant stream 82. Oxidant stream 82 also may be referred to herein as a pressurized air stream 82 and is provided to high pressure burner 130. High pressure burner 130 also receives a hydrocarbon stream 72 (such as from hydrocarbon supply system 70 of FIGS. 1-2), which also may be referred to herein as a pressurized hydrocarbon stream 72. The high pressure burner combusts pressurized hydrocarbon stream 72 within pressurized air stream 82 to generate a combustion gas stream 116. Combustion gas stream 116 is provided to a gas-liquid separation assembly 160, which separates a liquid stream 164 therefrom. Liquid stream 164 is returned to high pressure burner 130 to cool the high pressure burner, as discussed in more detail herein.

Figure 5:
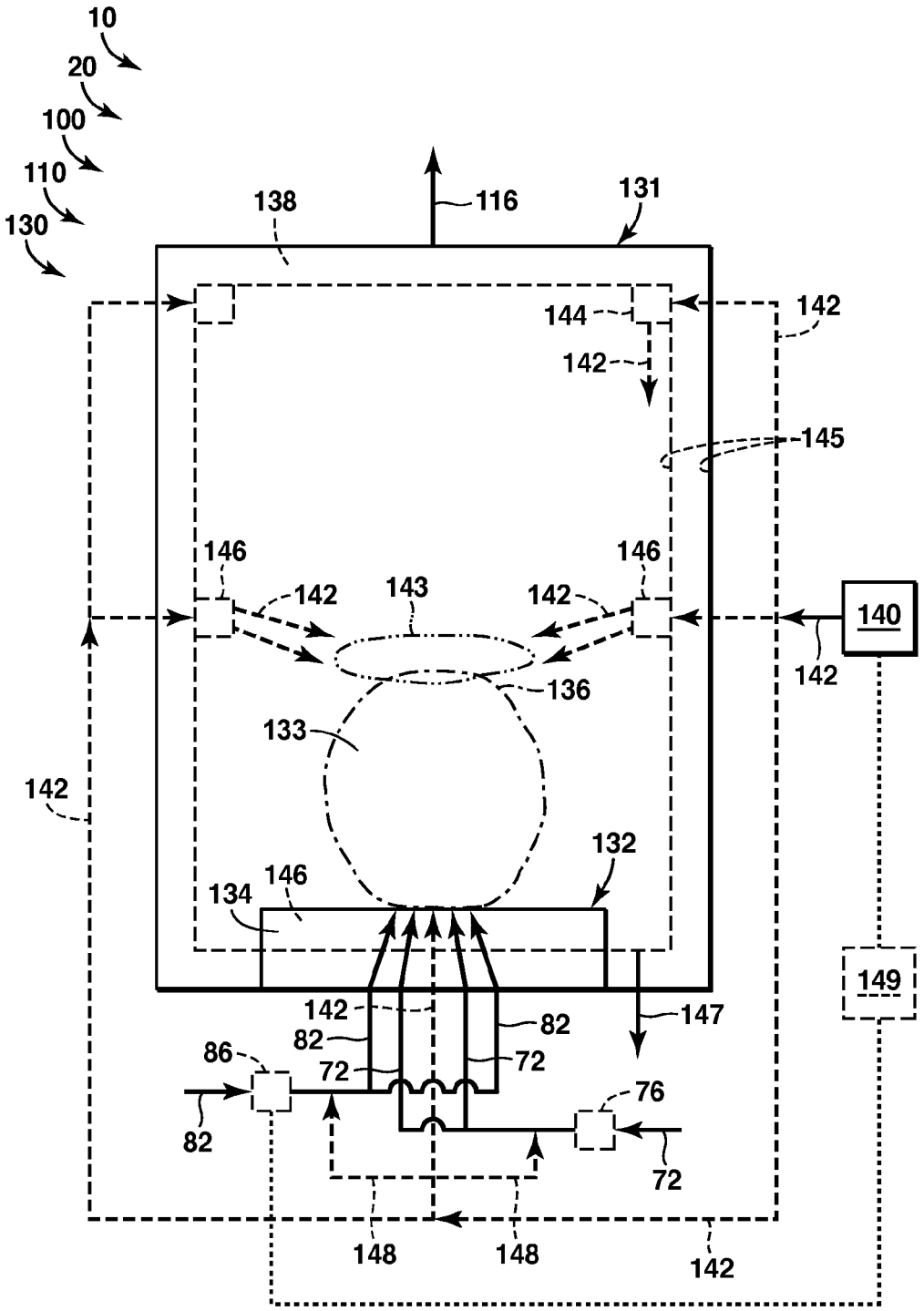
FIG. 5 provides less schematic, but still illustrative, non-exclusive examples, of a high pressure burner according to the present disclosure and which may be utilized in fracturing fluid generation assemblies according to the present disclosure.

As discussed in more detail herein with reference to FIG. 5, high pressure burner 130 includes a combustion chamber 131 that is configured to receive the pressurized hydrocarbon stream and the pressurized air stream. High pressure burner 130 further includes a mixing assembly 132 that is configured to mix the pressurized hydrocarbon stream and the pressurized air stream to produce, or generate, a combustible mixture. High pressure burner 130 further includes an ignition assembly 134, which is configured to ignite the combustible mixture to produce combustion gas stream 116, and a water injection system 140, which is configured to convey a cooling water stream in thermal contact with a portion of combustion chamber 131 to cool the portion of the combustion chamber.

It is within the scope of the present disclosure that fracturing fluid stream 102 may be produced directly from gas-liquid separation assembly 160 and/or provided directly to fracturing fluid supply assembly 200 and/or subterranean formation 50 from gas-liquid separation assembly 160. However, it is also within the scope of the present disclosure that the pressure of the fracturing fluid stream that is produced from gas-liquid separation assembly 160 may be increased, such as via a gas compression assembly 170, prior to being provided to fracturing fluid supply assembly 200 and/or subterranean formation 50. Additionally or alternatively, only a portion of fracturing fluid stream 102 may be produced from gas-liquid separation assembly 160. Under these conditions, and as discussed, the portion of the fracturing fluid stream may be combined with a supplemental gas stream 92 within a mixing structure 180 prior to the fracturing fluid stream being provided to fracturing fluid supply assembly 200 and/or to subterranean formation 50.

FIG. 5 provides less schematic (but still illustrative, non-exclusive) examples of a high pressure burner 130 according to the present disclosure. In FIG. 5, high pressure burner 130 includes a combustion chamber 131 that is configured to receive a pressurized hydrocarbon stream 72 and a pressurized air stream 82. Combustion chamber 131 may include a refractory lining 138 that lines at least a portion, if not all, of the combustion chamber. The high pressure burner further includes a mixing assembly 132 that is located within the combustion chamber and is configured to receive and mix the pressurized hydrocarbon stream and the pressurized air stream to generate, or produce, a combustible mixture 133. High pressure burner 130 also includes an ignition assembly 134, which is configured to ignite combustible mixture 133 within combustion chamber 131, and a water injection system 140.

Water injection system 140 is configured to convey a cooling water stream 142 in thermal contact with a portion of high pressure burner 130 to cool the portion of the high pressure burner. This may include conveying the cooling water stream in any suitable manner. As an illustrative, non-exclusive example, water injection system 140 may include one or more combustion chamber cooling nozzles 144. Combustion chamber cooling nozzles 144 are configured to direct cooling water stream 142 into thermal contact with a portion of high pressure burner 130. As illustrative, non-exclusive examples, the combustion chamber cooling nozzles may direct, spray, and/or flow the cooling water stream on and/or along an inner wall 145 of the combustion chamber.

As another illustrative, non-exclusive example, high pressure burner 130 may define a combustion region 136, wherein combustible mixture 133 is combusted, and water injection system 140 may include one or more combustion region cooling nozzles 146. Combustion region cooling nozzles 146 may be configured to direct cooling water stream 142 into combustion region 136 and/or into a cooling water spray zone 143 that may be adjacent to and/or above combustion region 136 to cool combustion gas stream 116 that is generated therein.

As yet another illustrative, non-exclusive example, water injection system 140 also may include one or more water supply conduits 148. Water supply conduits 148 may be configured to mix and/or combine cooling water stream 142 with pressurized hydrocarbon stream 72 and/or with pressurized air stream 82 (1) prior to the pressurized hydrocarbon stream and/or the pressurized air stream being received by mixing assembly 132, and/or (2) prior to the hydrocarbon stream and the pressurized air stream being combined within mixing assembly 132.

As another illustrative, non-exclusive example, high pressure burner 130 and/or water injection system 140 thereof further may include a water drain 147. Water drain 147 may be configured to remove water, which may pool and/or condense on a bottom surface of combustion chamber 131, from the combustion chamber.

As illustrated in dashed lines in FIG. 5, high pressure burner 130 further may include, be associated with, be in communication with, and/or be regulated and/or controlled by a combustion controller 149. As an illustrative, non-exclusive example, and as illustrated in dotted lines in FIG. 5, combustion controller 149 may be in communication with a pressurized air stream flow control structure 86 and/or with a pressurized hydrocarbon stream flow control structure 76. Combustion controller 149 further may be adapted, configured, and/or programmed to control a flow rate of pressurized air stream 82 and/or of pressurized hydrocarbon stream 72, respectively, therewith. This may include controlling the flow rate of the pressurized air stream and/or controlling the flow rate of the pressurized hydrocarbon stream to maintain the concentration of the combustible portion of combustion gas stream 116 below the lower flammability limit thereof. Additionally or alternatively, this also may include controlling the flow rate of the pressurized air stream and/or controlling the flow rate of the pressurized hydrocarbon stream to maintain the concentration of oxygen in combustion gas stream 116 below the limiting oxygen concentration for supporting combustion of combustible fluid 60 that is present within subterranean formation 50 (as illustrated in FIGS. 1-2).

As an illustrative, non-exclusive example, combustion controller 149 may be programmed to increase the flow rate of the pressurized air stream and/or decrease the flow rate of the pressurized hydrocarbon stream to maintain the concentration of the combustible portion of the combustion gas stream below an upper threshold combustible portion concentration. Additionally or alternatively, combustion controller 149 also may be programmed to decrease the flow rate of the pressurized air stream and/or increase the flow rate of the pressurized hydrocarbon stream to maintain the concentration of the combustible portion of the combustion gas stream above a lower threshold combustible portion concentration.

As yet another illustrative, non-exclusive example, combustion controller 149 may be programmed to increase the flow rate of the pressurized air stream and/or decrease the flow rate of the pressurized hydrocarbon stream to maintain the concentration of oxygen in the combustion gas stream above a lower threshold oxidant concentration. Additionally or alternatively, combustion controller 149 also may be programmed to decrease the flow rate of the pressurized air stream and/or increase the flow rate of the pressurized hydrocarbon stream to maintain the concentration of oxygen in the combustion gas stream below an upper threshold oxidant concentration.

As another illustrative, non-exclusive example, combustion controller 149 also may be programmed to control the operation of water injection system 140, such as to control a temperature within and/or of combustion chamber 131. As an illustrative, non-exclusive example, combustion controller 149 may be programmed to increase the flow rate of cooling water stream 142 to maintain the temperature within combustion chamber 131 below an upper threshold temperature. As another illustrative, non-exclusive example, combustion controller 149 also may be programmed to decrease the flow rate of cooling water stream 142 to maintain the temperature within combustion chamber 131 above a lower threshold temperature.

Figure 6:
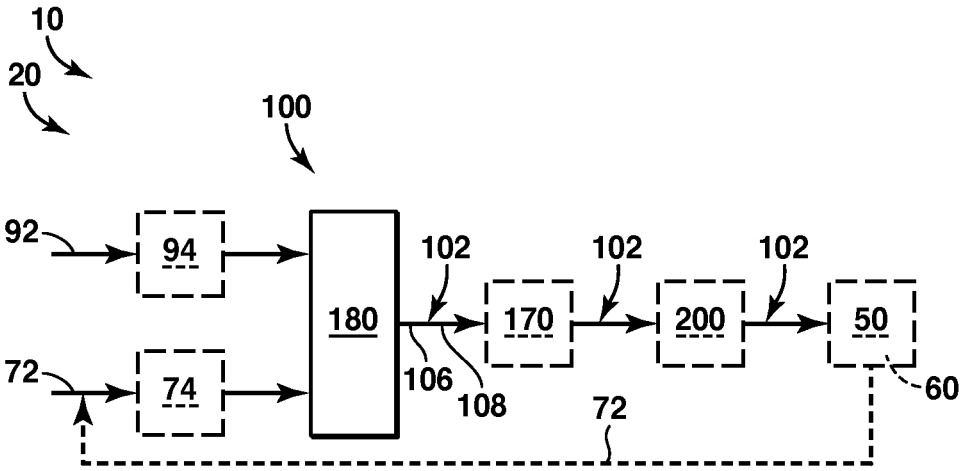
FIG. 6 is another schematic representation of illustrative, non-exclusive examples of a fracturing fluid generation assembly according to the present disclosure.

FIG. 6 is another schematic representation of illustrative, non-exclusive examples of a fracturing fluid generation assembly 100 according to the present disclosure. The fracturing fluid generation assembly of FIG. 6 includes a mixing structure 180 that receives a hydrocarbon stream 72 and a supplemental gas stream 92. As indicated in dashed lines in FIG. 6, hydrocarbon stream 72 and/or supplemental gas stream 92 optionally may be compressed with a hydrocarbon compressor 74 and/or a supplemental gas stream compressor 94, respectively, prior to being supplied to mixing structure 180. Mixing structure 180 combines hydrocarbon stream 72 and supplemental gas stream 92 to produce, or generate, a fracturing fluid stream 102.

It is within the scope of the present disclosure that fracturing fluid stream 102 may be produced from mixing structure 180 at a supply pressure at which it may be supplied to subterranean formation 50. However, it is also within the scope of the present disclosure that, as illustrated in dashed lines in FIG. 6, fracturing fluid generation assembly 100 further may include a gas compression assembly 170. Gas compression assembly 170 also may be referred to herein as a fracturing fluid stream compressor 170 and may be configured to compress the fracturing fluid stream to the supply pressure. The fracturing fluid stream then may be provided to a fracturing fluid supply assembly 200, illustrative, non-exclusive examples of which are discussed herein, prior to being provided to subterranean formation 50.

As discussed, fracturing fluid stream 102 includes a combustible portion 106 and also may include oxygen 108. As also discussed, mixing structure 180 is configured to combine hydrocarbon stream 72 with supplemental gas stream 92 in a proportion such that the concentration of combustible portion 106 in, or within, fracturing fluid stream 102 is less than, or below, the lower flammability limit of the combustible portion in, or within, the fracturing fluid stream. In addition, and as also discussed, mixing structure 180 also is configured to combine hydrocarbon stream 72 with supplemental gas stream 92 in a proportion such that the concentration of oxygen in the fracturing fluid stream is less than a limiting oxygen concentration for supporting combustion of combustible fluid 60 that is present within subterranean formation 50. As such, fracturing fluid stream 102 cannot combust and/or explode if exposed to an oxidant, such as oxygen in air. Similarly, fracturing fluid stream 102 cannot support combustion of combustible fluid 60, thereby permitting safe use of fracturing fluid stream 102 to fracture subterranean formation 50.

Hydrocarbon stream 72 may include any suitable hydrocarbon stream. As illustrative, non-exclusive examples, hydrocarbon stream 72 may include and/or be a natural gas stream, a methane stream, and/or a liquid hydrocarbon stream. As another illustrative, non-exclusive example, and as illustrated in dashed lines in FIG. 6, hydrocarbon stream 72 may be produced from the same subterranean formation 50 into which fracturing fluid stream 102 is, or will be, injected, provided, and/or supplied.

Supplemental gas stream 92 may include any suitable gas, combination of gasses, and/or chemical composition that may permit mixing with hydrocarbon stream 72 to produce, or generate, fracturing fluid stream 102. As illustrative, non-exclusive examples, supplemental gas stream 92 may include, comprise, consist of, consist essentially of, and/or be an inert gas, a combustion gas (i.e., a product of a combustion reaction), nitrogen, carbon dioxide, natural gas, methane, and/or any suitable combination thereof.

Figure 7:
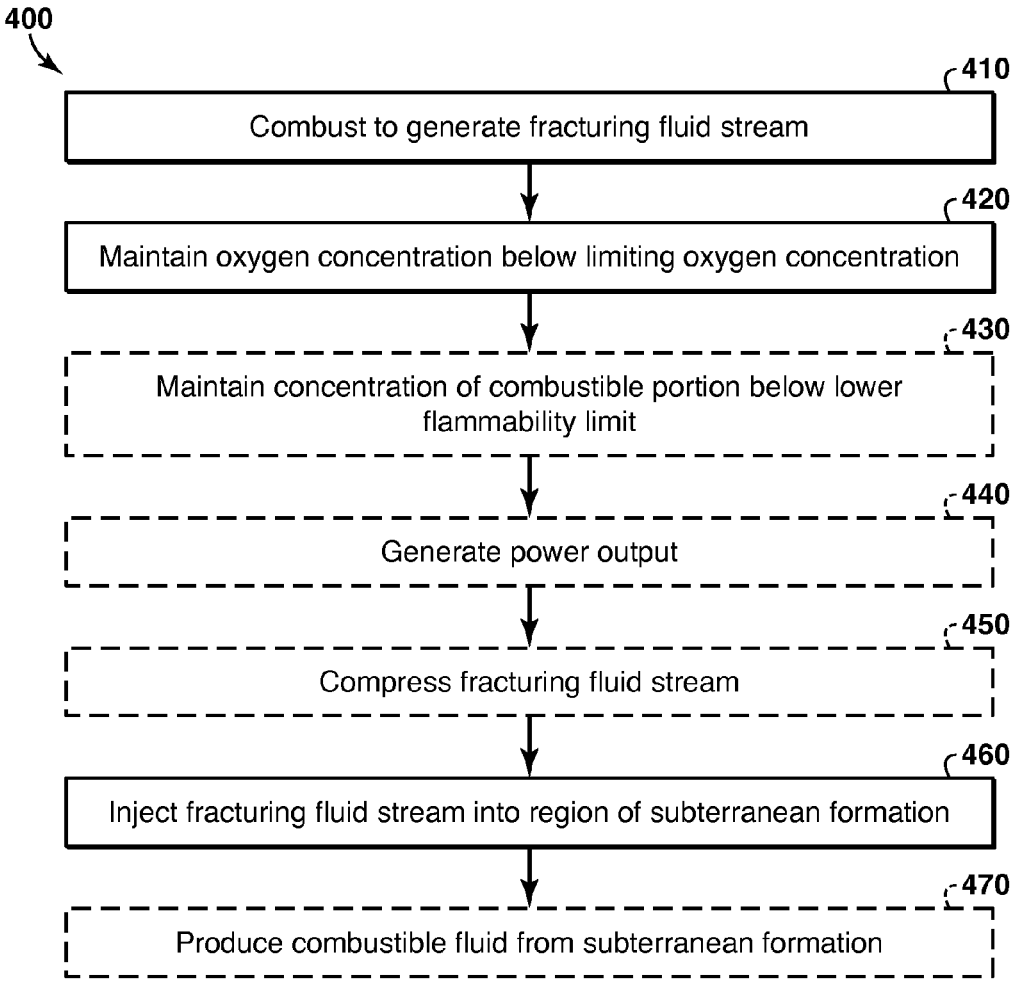
FIG. 7 is a flowchart depicting methods according to the present disclosure for enhancing production of a combustible fluid from a region of a subterranean formation.

FIG. 7 is a flowchart depicting methods 400 according to the present disclosure of enhancing production of a combustible fluid from a region of a subterranean formation. Methods 400 include combusting a fuel stream with an oxidant stream to generate a fracturing fluid stream at 410 and maintaining an oxygen concentration in the fracturing fluid stream below a limiting oxygen concentration for supporting combustion of the combustible fluid at 420. Methods 400 further may include maintaining, at 430, a concentration of a combustible portion of the fracturing fluid stream below a lower flammability limit of the combustible portion of the fracturing fluid stream, generating, at 440, a power output during the combusting at 410, and/or compressing the fracturing fluid stream at 450. Methods 400 further include injecting the fracturing fluid stream into the region of the subterranean formation at 460 and also may include producing the combustible fluid from the subterranean formation at 470.

Combusting the fuel stream with the oxidant stream to generate the fracturing fluid stream at 410 may include combusting any suitable fuel stream with any suitable oxidant stream to produce, or generate, the fracturing fluid stream. As illustrative, non-exclusive examples, the fuel stream may include and/or be a hydrocarbon stream, a gaseous hydrocarbon stream, a liquid hydrocarbon stream, natural gas, and/or methane. As additional illustrative, non-exclusive examples, the oxidant stream may include an oxygen stream, an air stream, and/or a compressed air stream. The combusting at 410 may include combusting within a combustion assembly, and the fracturing fluid stream also may be referred to herein as, may include, and/or may be a combustion stream and/or a combustion product stream that is produced by the combustion assembly and may define any suitable composition, illustrative, non-exclusive examples of which are disclosed herein.

Maintaining the oxygen concentration in the fracturing fluid stream below the limiting oxygen concentration for supporting combustion of the combustible fluid at 420 may include maintaining, regulating, and/or controlling the oxygen concentration in the fracturing fluid stream in any suitable manner. As an illustrative, non-exclusive example, the maintaining at 420 may include increasing a flow rate of the oxidant stream and/or decreasing a flow rate of the fuel stream to maintain the concentration of oxygen in the fracturing fluid stream above a lower threshold oxidant concentration. As another illustrative, non-exclusive example, the maintaining at 420 also may include decreasing the flow rate of the oxidant stream and/or increasing the flow rate of the fuel stream to maintain the concentration of oxygen in the fracturing fluid stream below an upper threshold oxidant concentration. As yet another illustrative, non-exclusive example, the maintaining at 420 may include maintaining the oxygen concentration to be less than a threshold fraction of the limiting oxygen concentration and/or less than a threshold oxygen concentration, illustrative, non-exclusive examples of which are disclosed herein.

Maintaining, at 430, the concentration of the combustible portion of the fracturing fluid stream below the lower flammability limit of the combustible portion of the fracturing fluid stream may include maintaining, regulating, and/or controlling the concentration of the combustible portion of the fracturing fluid stream in any suitable manner. As an illustrative, non-exclusive example, the maintaining at 430 may include increasing the flow rate of the oxidant stream and/or decreasing the flow rate of the fuel stream to maintain the concentration of the combustible portion of the fracturing fluid stream below an upper threshold combustible portion concentration. As another illustrative, non-exclusive example, the maintaining at 420 also may include decreasing the flow rate of the oxidant stream and/or increasing the flow rate of the fuel stream to maintain the concentration of the combustible portion of the fracturing fluid stream above a lower threshold combustible portion concentration. As yet another illustrative, non-exclusive example, the maintaining at 430 may include maintaining the concentration of the combustible portion to be less than a threshold fraction of the lower flammability limit and/or less than a threshold combustible portion concentration, illustrative, non-exclusive examples of which are disclosed herein.

Generating, at 440, the power output during the combusting at 410 may include generating the power output with the combustion assembly. As illustrative, non-exclusive examples, the combustion assembly may include and/or be a turbine, an engine, an internal combustion engine, a combustion assembly, a low pressure burner, and/or a high pressure burner that is configured to generate both the fracturing fluid stream and the power output.

It is within the scope of the present disclosure that the combusting at 410 may generate the fracturing fluid stream at a pressure that is sufficient to fracture the subterranean formation during the injecting at 460 (such as at a pressure that is greater than a fracture pressure of the subterranean formation). However, it is also within the scope of the present disclosure that the generating at 410 may include generating the fracturing fluid stream at a pressure that is less than the fracture pressure of the subterranean formation, and/or at a pressure that is less than a desired pressure for the fracturing fluid stream that is injected during the injecting at 460.

Under these conditions, methods 400 further may include compressing the fracturing fluid stream at 450. Compressing the fracturing fluid stream at 450 may include compressing the fracturing fluid stream to the pressure that is sufficient to fracture the subterranean formation and/or compressing the fracturing fluid stream to a pressure that is equal to, or greater than, the desired pressure for the fracturing stream and may be accomplished using any suitable structure, such as the gas compression assemblies that are discussed herein. When methods 400 include the compressing at 450, the power output that is generated during the generating at 440 may be utilized to power at least a portion of the compressing at 450.

Injecting the fracturing fluid stream into the region of the subterranean formation at 460 may include injecting the fracturing fluid stream to generate a pressure within the region that is greater than the fracture pressure of the region and/or injecting the fracturing fluid stream to fracture the region. This may include providing the fracturing fluid stream to the subterranean formation from a surface region, flowing the fracturing fluid stream through a wellbore from the surface region to the subterranean formation, providing the fracturing fluid stream to the subterranean formation at a supply pressure, illustrative, non-exclusive examples of which are disclosed herein, and/or providing the fracturing fluid stream to the subterranean formation at a supply temperature, illustrative, non-exclusive examples of which are disclosed herein.

Producing the combustible fluid from the subterranean formation at 470 may include producing the combustible fluid from the subterranean formation in any suitable manner and/or using any suitable structure. As an illustrative, non-exclusive example, the producing at 470 may include flowing the combustible fluid through a wellbore of a hydrocarbon well from the subterranean formation to the surface region.

When methods 400 include the producing at 470, it is within the scope of the present disclosure that the fuel stream that is combusted during the combusting at 410 may include and/or be at least a portion of the combustible fluid that is produced during the producing at 470. As such, at least the combusting at 410, the maintaining at 420, the injecting at 460, and the producing at 470 may be performed at a combustible fluid production site that is configured to perform methods 400. This may permit performing methods 400 without the need to transport and/or otherwise convey a fracturing fluid stream, or any portion thereof, to the combustible fluid production site.

Figure 8:
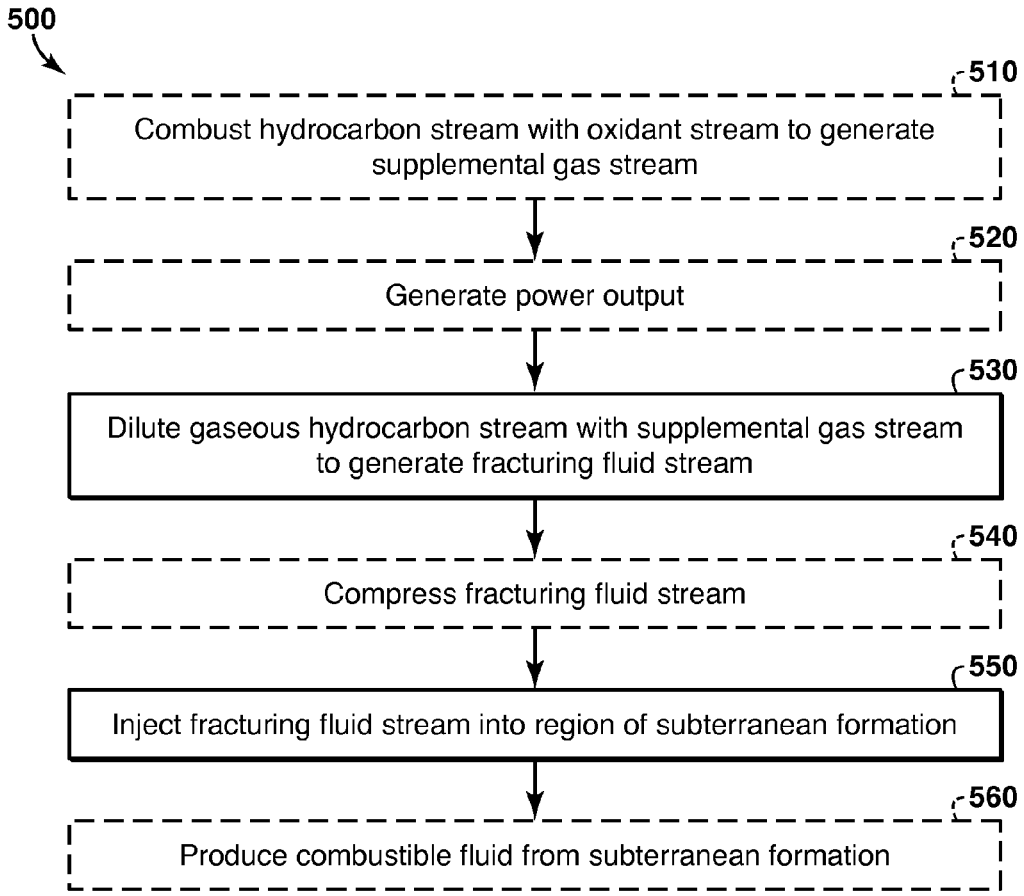
FIG. 8 is a flowchart depicting additional methods according to the present disclosure for enhancing production of a combustible fluid from a region of a subterranean formation.

FIG. 8 is a flowchart depicting methods 500 according to the present disclosure of enhancing production of a combustible fluid from a region of a subterranean formation. Methods 500 may include combusting a hydrocarbon stream with an oxidant stream to generate a supplemental gas stream at 510 and/or generating, at 520, a power output during the combusting at 510. Methods 500 include diluting a gaseous hydrocarbon stream with the supplemental gas stream to generate a fracturing fluid stream at 530 and may include compressing the fracturing fluid stream at 540. Methods 500 further include injecting the fracturing fluid stream into the region of the subterranean formation at 550 and may include producing the combustible fluid from the subterranean formation at 560.

Combusting the hydrocarbon stream with the oxidant stream to generate the supplemental gas stream at 510 may include combusting any suitable hydrocarbon stream to generate the supplemental gas stream and may be at least substantially similar to the combusting at 410, which is discussed herein. As an illustrative, non-exclusive example, and when methods 500 include the producing at 560, the combustible fluid may form a portion, or even all, of the hydrocarbon stream, and the combusting at 510 may include combusting the combustible fluid.

Generating, at 520, the power output during the combusting at 510 may include generating the power output in any suitable manner and may be at least substantially similar to the generating at 440, which is discussed herein. As discussed, this may include combusting the hydrocarbon stream with, or within, any suitable turbine, engine, internal combustion engine, combustion assembly, low pressure burner, and/or high pressure burner to generate the power output.

Diluting the gaseous hydrocarbon stream with the supplemental gas stream to generate the fracturing fluid stream at 530 may include generating a fracturing fluid stream that includes a combustible portion and that also may include oxygen. In addition, the diluting further may include diluting such that a concentration of the combustible portion is below a lower flammability limit of the combustible portion in the fracturing fluid stream. Additionally or alternatively, the diluting also may include diluting such that an oxygen concentration in the fracturing fluid stream is less than a limiting oxygen concentration for supporting combustion of the combustible fluid within the subterranean formation. Thus, and as discussed, the fracturing fluid stream cannot combust and/or explode if exposed to air. In addition, and as also discussed, the fracturing fluid stream also cannot support combustion of the combustible fluid within the subterranean formation. Illustrative, non-exclusive examples of the supplemental gas stream are disclosed herein.

Compressing the fracturing fluid stream at 540 may include compressing the fracturing fluid stream in any suitable manner and/or utilizing any suitable structure. Compressing the fracturing fluid stream at 540 may be at least substantially similar to the compressing at 450, which is discussed in more detail herein. As an illustrative, non-exclusive example, the diluting at 530 may generate the fracturing fluid stream at a pressure that is below a fracture pressure of the region of the subterranean formation and/or at a pressure that is less than a desired pressure for injection of the fracturing fluid stream into the subterranean formation. Under these conditions, methods 500 may include the compressing at 540 to pressurize the fracturing fluid stream to a pressure that is greater than the fracture pressure of the region of the subterranean formation and/or to a pressure that is greater than the desired pressure for injection of the fracturing fluid stream into the subterranean formation.

When methods 500 include the generating at 520 and the compressing at 540, the power output from the combustion assembly may be utilized to power at least a portion of the compressing at 540. This may include transferring the power output from the combustion assembly to a gas compression assembly via any suitable power transfer structure, as discussed herein.

Injecting the fracturing fluid stream into the region of the subterranean formation at 550 may include injecting to generate a pressure within the region that is greater than the fracture pressure of the region. This may include injecting in a manner that may be at least substantially similar to the injecting at 460, which is discussed herein.

Producing the combustible fluid from the subterranean formation at 560 may include producing the combustible fluid from the subterranean formation in any suitable manner and/or using any suitable structure and may be at least substantially similar to the producing at 470, which is discussed herein. As an illustrative, non-exclusive example, the producing at 560 may include flowing the combustible fluid through a wellbore of a hydrocarbon well from the subterranean formation to the surface region.

When methods 500 include the producing at 560, it is within the scope of the present disclosure that the gaseous hydrocarbon stream that is diluted during the diluting at 530 may include and/or be at least a portion of the combustible fluid that is produced during the producing at 560. As such, at least the diluting at 530 and the injecting at 550, and optionally a remainder of methods 500, may be performed at a combustible fluid production site that is configured to perform methods 500. This may permit performing methods 500 without the need to transport and/or otherwise convey a fracturing fluid stream, or any portion thereof, to the combustible fluid production site.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of enhancing production of a combustible fluid from a region of a subterranean formation below a surface region, the method comprising:

combusting a fuel stream with an oxidant stream within a combustion assembly located at a surface region to generate a combusted fuel and oxidant combustion product fluid stream for use as a fracturing fluid stream, wherein the fracturing fluid stream comprises the combustion product fluid stream;

maintaining a concentration of oxygen in the fracturing fluid stream comprising the combustion product below a limiting oxygen concentration for supporting combustion of the combustible fluid within the subterranean formation;

cooling the fracturing fluid stream to a temperature of less than 200° C., flowing the cooled fracturing fluid stream through a wellbore from the surface region to the subterranean formation; and injecting the cooled fracturing fluid stream into the region of the subterranean formation at a pressure within the region of the subterranean formation that is greater than a hydraulic fracture pressure of the region of the subterranean formation to hydraulically fracture the subterranean formation.

2. The method of claim 1, wherein the method further includes producing the combustible fluid from the subterranean formation, wherein the fuel stream includes the combustible fluid.

3. The method of claim 2, wherein the combusting, the injecting, and the producing include combusting, injecting, and producing at a combustible fluid production site.

4. The method of claim 1, wherein the combusting includes generating a power output with the combustion assembly, wherein the method further includes compressing the fracturing fluid stream prior to the injecting, and further wherein the method includes utilizing the power output from the combustion assembly to power at least a portion of the compressing.

5. The method of claim 1, wherein the fracturing fluid stream includes a combustible portion, and further wherein the method includes maintaining a concentration of the combustible portion in the fracturing fluid stream below a lower flammability limit of the combustible portion in the fracturing fluid stream.

6. A method of enhancing production of a combustible fluid from a region of a subterranean formation, the method comprising:

diluting a gaseous hydrocarbon stream with a supplemental gas stream to generate a fracturing fluid stream, wherein the supplemental gas stream is formed by combusting a hydrocarbon stream with an oxidant stream at a surface location;

wherein the fracturing fluid stream has an oxygen concentration and a combustible portion, wherein a concentration of the combustible portion in the fracturing fluid stream comprising the combustion product is below a lower flammability limit of the combustible portion in the fracturing fluid stream, and wherein the oxygen concentration in the fracturing fluid stream is less than a limiting oxygen concentration for supporting combustion of the combustible fluid within the subterranean formation;

cooling the fracturing fluid stream to a temperature of less than 200° C.; and injecting the cooled fracturing fluid stream into the region of the subterranean formation at a pressure within the region that is greater than a hydraulic fracture pressure of the region of the subterranean formation to hydraulically fracture the subterranean formation.

7. The method of claim 6, wherein the supplemental gas stream comprises at least 90 mole % of a non-combustible fluid that includes at least one of carbon dioxide, nitrogen, and water vapor.

8. The method of claim 6, wherein the diluting and the injecting include diluting the gaseous hydrocarbon stream and injecting the fracturing fluid stream at a combustible fluid production site.

9. The method of claim 6, wherein the method further includes producing the combustible fluid from the subterranean formation, wherein at least a portion of the combustible fluid forms a portion of the gaseous hydrocarbon stream.

10. The method of claim 6, wherein the method further includes combusting a hydrocarbon stream with an oxidant stream in a combustion assembly to generate the supplemental gas stream.

11. The method of claim 10, wherein the combusting includes generating a power output with the combustion assembly, wherein the method further includes compressing the fracturing fluid stream prior to the injecting, and further wherein the method includes utilizing the power output from the combustion assembly to power at least a portion of the compressing.

* * * * *